United States Patent [19]

Neuman

[11] 3,930,341

[45] Jan. 6, 1976

[54] UNIVERSAL VERTICAL GRINDING MACHINE

[76] Inventor: Marcel Neuman, 8 Avenue des Peupliers, Embourg, Belgium

[22] Filed: Feb. 1, 1974

[21] Appl. No.: 438,770

[52] U.S. Cl. ..... 51/89; 51/73 R; 51/105 R; 51/227 R

[51] Int. Cl.[2] ..... B24B 5/06; B24B 17/00

[58] Field of Search.... 51/88, 89, 73 R, 277, 103 R, 51/105 R, 130, 48, 49

[56] References Cited

UNITED STATES PATENTS

| | | | |
|---|---|---|---|
| 2,332,421 | 10/1943 | Wildhaber | 51/89 |
| 2,723,499 | 11/1955 | Dix | 51/48 R |
| 2,807,916 | 10/1957 | Squire et al. | 51/88 |
| 2,826,876 | 3/1958 | Menard | 51/48 R |
| 3,269,063 | 8/1966 | Hahn et al. | 51/48 R |

*Primary Examiner*—Othell M. Simpson
*Attorney, Agent, or Firm*—Clarence A. O'Brien; Harvey B. Jacobson

[57] ABSTRACT

A universal vertical grinding machine has a horizontal base supporting at least one workpiece carrier device. A vertical column centered on the base provides an axis of rotation for at least one collar rotatably mounted with reference to the column and provided with at least one head comprising a grinder-carrier spindle supporting a grinder adjacent the workpiece carrier device. Suitable arrangements are provided for effecting an axial sliding of the collar along the column in a reciprocating manner, and to independently rotate the collar about the column. Advantageously, there are two collars mounted for rotation about the column, with the collars being rotated in opposite directions.

13 Claims, 4 Drawing Figures

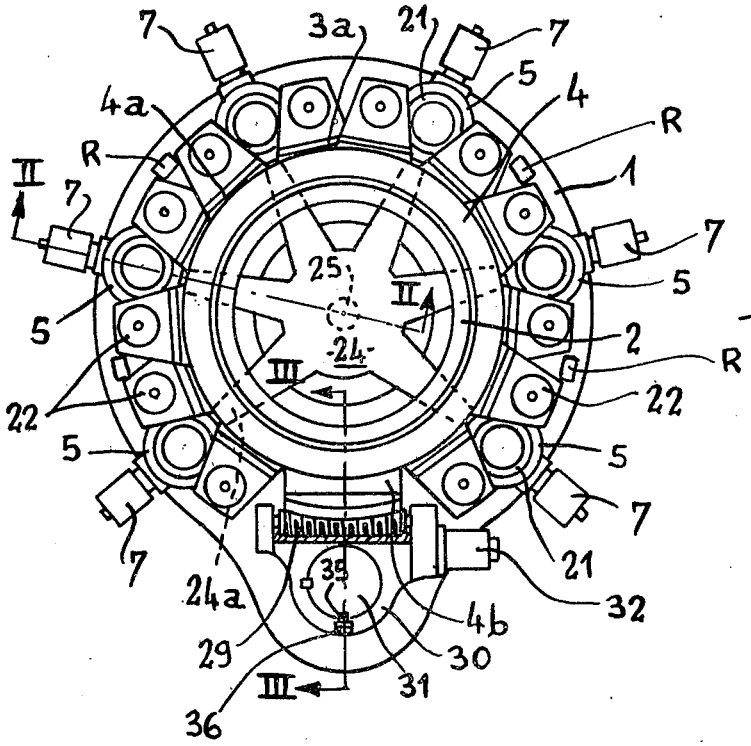
Fig. 1
Fig. 2
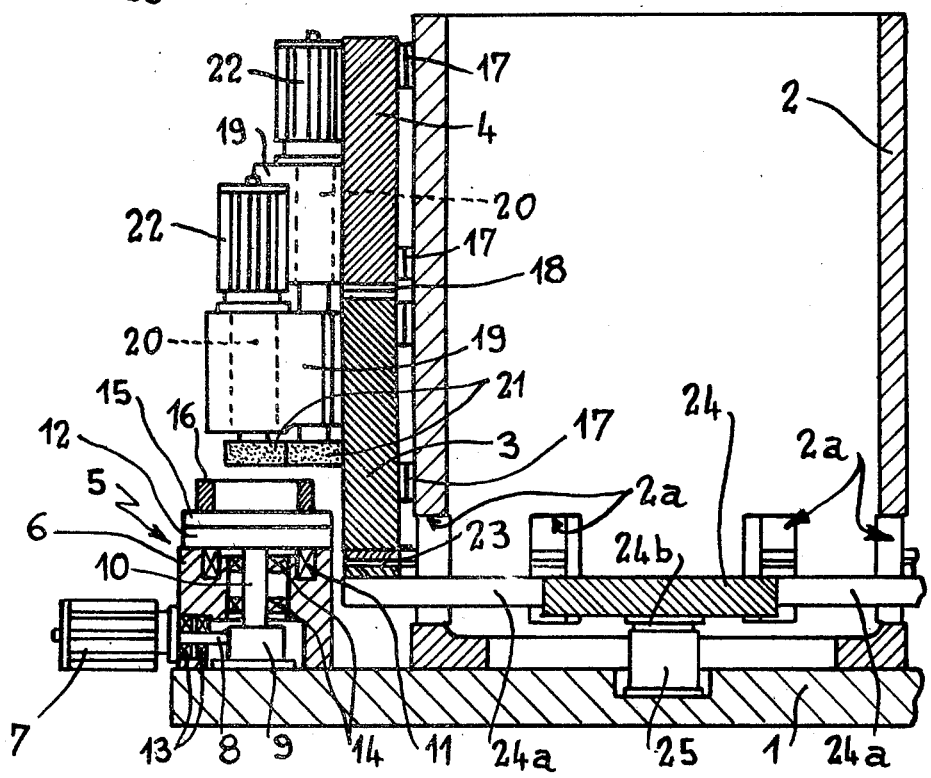

UNIVERSAL VERTICAL GRINDING MACHINE

BACKGROUND OF THE INVENTION

The present invention relates to improvements in vertical truing apparatus, especially those intended for simultaneous truing of the bore and the periphery of annular rings.

Known machines of the kind in question comprise as we know a horizontal crosspiece associated with two fixed uprights supporting one or more heads or grinder-carrier carriages. When it is desired to true pieces of large diameter, the crosspiece has a considerable length. Moreover, the geometric axis of the spindle carrying the grinder is disposed at a rather large distance from the crosspiece since intermediate pieces have to be provided that will allow the pivoting of the grinder-carrier head in a vertical plane. Thus, in known machines there are great difficulties in achieving vertical orientation of the spindle in a precise manner because of the deformations of the different organs from the weight of the carriages.

SUMMARY OF THE INVENTION

The improvements that are the subject of the present invention are intended to remedy these drawbacks and to allow development of a vertical truing machine with high precision of orientation of its members, capable of truing pieces with very close machining tolerances.

The truing machine of the invention is essentially characterized in that it comprises in combination:

- a horizontal base supporting at least one workpiece carrier;
- a vertical column centered on the said base;
- at least one collar mounted pivotably with reference to the column, and provided with at least one head comprising a grinder-carrier spindle;
- means to cause the collar to slide axially in alternating directions along the column;
- other means for alternating angular drive of the collar; and
- means for controlling the movements of the collar.

The attached drawing, given by way of example, will allow better comprehension of the invention, its characteristics and the advantages that it may offer.

BRIEF DESCRIPTION OF THE DRAWINGS

FIG. 1 is a plan view of a machine according to the invention.

FIGS. 2 and 3 are sections on a larger scale along II—II and III—III (FIG. 1).

DESCRIPTION OF THE PREFERRED EMBODIMENT

Figure 3:
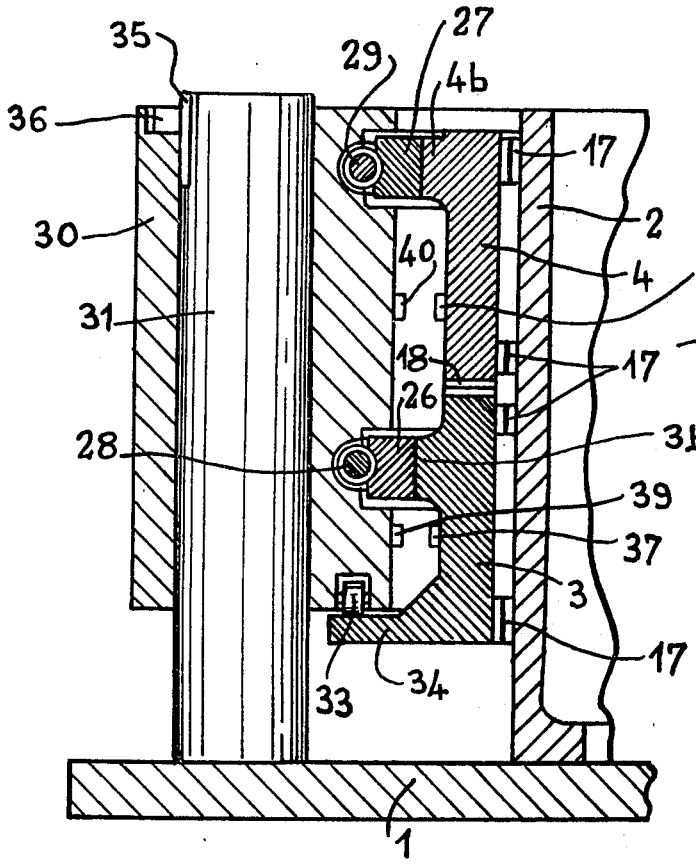

The machine of the invention illustrated in FIGS. 1 and 2 comprises essentially a base 1 that supports a hollow vertical column 2 about which there are mounted two collars 3 and 4.

The base of column 2 is fixed in any suitable way, for example by bolting to the central part of base 1 which in plan has a generally circular profile.

The periphery of base 1 receives workpiece carrier devices 5, in the number of six in the present example. Each device 5 comprises a frame 6 on the periphery of which there is fixed an electric motor 7 whose shaft 8 is in engagement with a bevel gear 9. Output shaft 10 of the latter element, vertically oriented, bears a circular plate, or bearing, 11 turning on turning plate , or bearing, 12. Shafts 8 and 10 are guided by two sets of roller bearings 13 and 14. On turning plate 12 there is fixed, for example, a magnetic plate 15 that immobilizes a piece to be trued, 16, in the form of an annulus like the outer or inner ring of a ball or roller bearing.

The two collars 3 and 4 are mounted in rotation with reference to column 2 by suitable roller devices, but preferably by means of hydrostatic bearings 17 which are well known in the art and which it is therefore unnecessary to describe. Collar 4 rests on collar 3 by means of hydrostatic bearings 18.

The periphery of each collar 3, 4 is arranged with lands 3*a*, 4*a* on each of which there is fixed a grinder-carrier carriage 19 which is pivotable about a horizontal axis. Each carriage is associated with a turning vertical spindle 20 whose lower end is rigidly connected with a grinder 21, while its upper end is connected to the shaft of an electric motor 22.

It is to be observed that the spindle of each carriage 19, rigidly connected with collar 4, is longer than that borne by each of the carriages associated with the lower collar 3 so that all the grinders are in the same horizontal plane. Preferably it is arranged so that the geometric axes of the spindles in vertical position are disposed on a circumference that passes through the centers of workpiece carriers 5.

It is also to be observed that lands 3*a*, 4*a* are shifted with reference to each other so that each of the workpiece carrier devices 5 is placed between two grinders 21 respectively associated with collars 3 and 4.

Lower collar 3 rests, by means of hydrostatic bearings 23, on the six branches 24*a* of a disk 24 whose center is made to constitute a piston 24*b* which is displaceable in a cylinder 25 that is rigidly connected to base 1. Each branch 24*a* passes through an opening 2*a* in the wall of hollow column 2, disk 24 being disposed inside the said column.

Each collar 3, 4 is provided with a peripheral protuberance 3*b*, 4*b*, to which is fixed a sector of hollow wheel 26, 27 (FIG. 3) which engages with an endless screw respectively 28 or 29 whose ends are borne by bearings that are rigidly connected to a vertical sleeve 30 that can slide along vertical shaft 31 fixed on an extension of base 1. This sleeve is keyed on the shaft so that it is angularly fixed. Each of screws 28, 29 is driven in rotation by a motor such as 32 (FIG. 1), which motor may be either electric or hydraulic.

Sleeve 30 rests by means of a wheel 33 on an arm 34 that is rigidly connected to lower collar 3 (FIG. 3).

Known devices R are disposed on base 1 for regrinding of the grinders.

A linear inductosyn 35 is associated with shaft 31, and a movable slide 36 is correspondingly fixed on sleeve 30 so that it is possible to control the vertical displacements of the said sleeve. For angular displacement control of the respective collars 3, 4 there is placed on each of them an angular inductosyn 37, 38, while the sensors 39, 40 are respectively fixed on the sleeve opposite the above mentioned inductosyn devices.

The operation becomes evident from the above explanations.

Each magnetic plate 15, driven in rotation by motor 7, immobilizes a piece 16 whose bore and periphery are to be trued. By acting on the appropriate valve there is caused displacement of piston 24*b* so that the grinders are in a horizontal plane situated right above the upper face of pieces 16. Collars 3 and 4 are then caused to turn in such a way that the grinders respectively associated therewith are placed perpendicularly to the outer and inner vertical faces of each workpiece 16.

By means of an assembly of suitable valves, there can easily be caused an alternating movement of piston 24*b* vertically in cylinder 25, so that the disk 24 and its branches 24*a* are given an identical movement that is transmitted to lower collar 3 and to collar 4. The grinders thus have a reciprocating movement whose course is controlled as a function of the height of pieces 16.

Each motor 22 is thus supplied so that the grinders 21 are put into rotation. Because of motors 32 it is possible to act on endless screws 28, 29 to cause rotation of collars 3 and 4. It is arranged so that the screws 28, 29 are actuated in opposite directions so that the two collars move in the same way as the screws 28, 29, with the two grinders 21 machining the piece moving in a direction away from each other. Thus each piece is subject to practically no stresses that would withdraw it from the retaining effect of magnetic plate 15. It is readily appreciated that the movement of the respective collars corresponds to the advance of the corresponding grinder with reference to the workpiece.

Six workpieces 16, simultaneously put into rotation by the six motors 7, are fixed on the six magnetic plates 15. A carriage 19 and a carriage 20 correspond to each one of the six pieces 16, with the six carriages 19 being fixed on the collar 4 and the six carriages 20 being fixed on the collar 3. Each collar 3, 4 is independent of the other, with each workpiece 16 being ground simultaneously by two grinders 21.

In the case where, for example, the inner diameter and outer diameter of a ring are being ground to a predetermined size, it is possible to bring the grinder 21 which acts on the inner diameter near to the grinder 21 which acts on the outer diameter by means of actuation of motors 31 which cause collars 3 and 4 to rotate in opposite directions. Thus, workpieces 16 will be maintained between the two grinders 21 and the radial forces of the grinders 21 will be opposed. This specific movement of these various elements eliminates the possibility that the workpiece 16 will slide relative to the magnetic plate 15 on which it is mounted, a problem encountered with conventional grinding apparatus of the kind having a horizontal crosspiece with which it is impossible to bring the carriages sufficiently near to one another. The latter is both due to the cumbersome construction of the conventional grinding apparatus, and because the conventional grinding apparatus has carriages which are both mounted on the same sliding bars.

Of course, substantial lubrication is provided to promote the work of the grinders.

Figure 4:
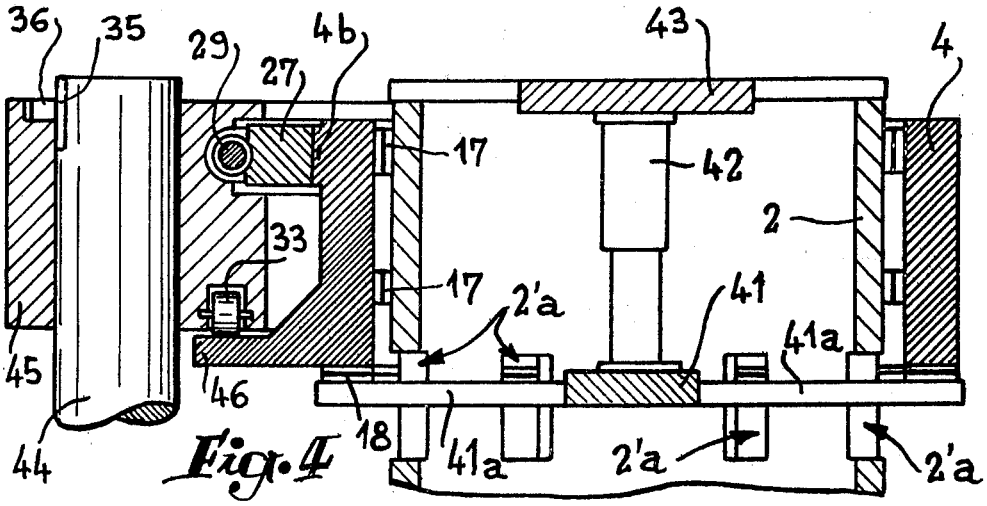
FIg. 4 illustrates a variant of execution in partial view, corresponding to FIG. 3.

It will be observed that the two collars 3 and 4 could be independent of one another and move individually along the column. For this it would suffice to provide a second disk 41 (FIG. 4) associated with a jack 42 fixed to the upper part of the said column by means of a crosspiece 43.

Arms 41*a* of disk 41 then pass through the wall of column 2 in openings 2′*a* so as to support collar 4 by means of hydrostatic bearings 18.

A second vertical shaft 44 is provided, about which there is engaged another sleeve 45 bearing on an arm 46 that is rigidly connected with upper collar 4, the said second sleeve constituting a bearing for screw 29.

It is obvious that all motors provided on the truing device are variable speed type motors.

Thus there is developed a vertical truing device with multiple stations which allows considerable advances and cutting speeds without risk of any deformation of the grinder-carrier carriages, the said supports being constituted by collars 3 and 4 which cannot bend. Moreover, these carriages are directly fixed to the corresponding collar so that the overhang of their spindle is considerably reduced, with respect to that of conventional truing apparatus. Thus any desired precision in machining can be attained, as required for pieces with very tight tolerances.

Moreover, because of the special arrangement of the organs of the truing apparatus of the invention, the number of control apparatus is considerably reduced with reference to those necessary with conventional machines for an identical number of spindles and workpiece holders.

It is further to be understood that the description above was only given as example and that it in no way limits the scope of the invention, which scope would not be exceeded by replacement of details of described embodiments by any other equivalents. Especially, and as is self evident the truing device of the invention could be used with a single workpiece holder device and/or for work other than cylindrical truing since the spindles can be disposed in any position in a single vertical plane.

What is claimed as new is as follows:

1. Universal vertical truing apparatus, comprising, in combination:

a horizontal base supporting at least one workpiece carrier device;

a vertical column centered on the base;

at least one collar rotatably mounted with reference to the column and provided with at least one head comprising a grinder-carrier spindle supporting a grinder adjacent the workpiece carrier device;

means for effecting axial sliding of the collar along the column in a reciprocating manner;

means separate from the means for effecting for rotating the collar about the column; and means for controlling the movements of the collar.

2. Truing apparatus as in claim 1, characterized in that the base is provided with a plurality of workpiece holder devices distributed equally about the column.

3. Truing device as in claim 2, characterized in that the collar comprises a number of grinder-carrier heads corresponding to the number of workpiece carrier devices.

4. Truing device as in claim 3, characterized in that the column is furnished with two collars that rotate independently in opposite directions, each of the collars being provided with a number of grinder-carrier heads that corresponds to the number of workpiece carrier devices.

5. Truing apparatus as in claim 4, characterized in that the two collars are mounted in application one above the other by means of suitable bearings disposed between them, the lower collar being connected to means for making it axially slidable.

6. Truing apparatus as in claim 4, characterized in that the two collars are slidably mounted on the column independently of each other, being moved by the far effecting axial sliding means.

7. Truing apparatus as in claim 2, characterized in that the workpiece carrier devices that are distributed equally about the column severally comprise a horizontal plate turning by means of suitable drives.

8. Truing apparatus as in claim 4, characterized in that athe trajectories of movement of the geometric axis of each grinder carrier spindle pass through a center of rotation of the workpiece carrier devices.

9. Truing device as in claim 5, characterized in that at least the lower collar rests by means of an appropriate stop on the arms of a disk whose center, coinciding with that of the column, is arranged so as to constitute a piston cooperating with a fixed cylinder suitably connected to a source of pressurized fluid, to allow the vertical reciprocating motion of the collar in question along the above mentioned column.

10. Truing device as in claim 9, characterized in that there is arranged on each collar a toothed sector that engages with an endless screw driven by a suitable mechanism at variable speed, each endless screw being mounted in rotation in bearings rigidly connected with a sleeve engaged about a fixed vertical shaft that is rigidly connected to the base, the lower part of the said sleeve resting by means of a wheel on an arm rigidly connected with the lower collar or with each collar.

11. Truing apparatus as in claim 10, characterized in that there is placed on the base and between the workpiece carrier devices as many regrinder organs as there are grinder carrier heads.

12. Truing apparatus as in claim 11, characterized in that the means for control of the movements of each collar comprises a reader of the movement of the sleeve in the vertical direction, and a system for controlling the angular movement of each collar.

13. Truing apparatus as in claim 1, characterized in that two collars are rotatably mounted with reference to the column, each of the collars being provided with at least one head comprising a grinder-carrier spindle supporting a grinder adjacent the workpiece carrier device, the collars rotating independently in opposite directions, the workpiece carrier device being mounted for rotation, and the trajectories of movement of geometric axes of the grinder-carrier spindles passing through a center of rotation of the workpiece carrier device.

* * * * *